US012220031B1

(12) United States Patent
Pugh et al.

(10) Patent No.: US 12,220,031 B1
(45) Date of Patent: Feb. 11, 2025

(54) HYDRATED LENS INSPECTION CONTAINER

(71) Applicant: Atheneum Optical Sciences, LLC, Orange Park, FL (US)

(72) Inventors: Randall Pugh, Jacksonville, FL (US); W. Anthony Martin, Orange Park, FL (US)

(73) Assignee: Atheneum Optical Sciences, LLC, Orange Park, FL (US)

( * ) Notice: Subject to any disclaimer, the term of this patent is extended or adjusted under 35 U.S.C. 154(b) by 0 days.

(21) Appl. No.: 18/823,653

(22) Filed: Sep. 3, 2024

Related U.S. Application Data

(60) Provisional application No. 63/536,475, filed on Sep. 4, 2023.

(51) Int. Cl.
*A45C 11/04* (2006.01)

(52) U.S. Cl.
CPC ..... *A45C 11/046* (2013.01)

(58) Field of Classification Search
CPC ..... A45C 11/046
USPC ..... 206/5.1; 248/372.1, 176.3
See application file for complete search history.

(56) References Cited

U.S. PATENT DOCUMENTS 4,308,947 A * 1/1982 Arnhem ..... A45C 11/005 294/1.2
4,609,171 A * 9/1986 Matsui ..... H02G 3/32 248/316.1
4,930,740 A * 6/1990 Vogt ..... B62J 11/00 24/17 AP

* cited by examiner

*Primary Examiner* — Andrew D Perreault
(74) *Attorney, Agent, or Firm* — Tracnik Law PLLC; Joseph P. Kincart

(57) ABSTRACT

Improved methods and apparatus for holding a polymeric optical lens, such as an ophthalmic lens (contact lens or intraocular lens "IOL"); or other polymeric item; in a hydrated state in a hydrated lens inspection container ("HLIC") that is conducive for measurement of characteristics of the ophthalmic lens (or other polymeric item) being inspected. According to the present invention, a HLIC receives the polymeric optical lens into a HLIC lens retention cavity, and a hydration fluid fills the HLIC to a level above a cavity upper edge of the HLIC container, hydration fluid is permitted to reach a level above the cavity upper edge via formation of a meniscus with the hydration liquid.

20 Claims, 9 Drawing Sheets

HLIC with Lens Sealed In

HYDRATED LENS INSPECTION CONTAINER

CROSS-REFERENCE TO RELATED APPLICATIONS

This application claims the benefit of U.S. Provisional Application No. 63/536,475, filed on Sep. 4, 2023, the contents of which are hereby incorporated by reference.

FIELD OF THE INVENTION

The present invention relates to the field of optical lenses, and in particular, to a lens holder for convenient handling of a polymeric ophthalmic lens in hydrating fluid.

BACKGROUND OF THE INVENTION

Polymeric contact lenses and intraocular lenses are medical devices, and require inspection to be able to ascertain characteristics of the contact lens while the lens is in a hydrated state. Currently as many as 1.0 billion contact lenses are manufactured each year. It is good practice to inspect a portion of manufactured lenses. It is also good practice to inspect lenses during development of new lenses and lens manufacturing processes. Inspection often requires that the lens be in a hydrated state during an inspection process.

However, during the inspection of the lenses in the hydrated state, air bubbles may form and remain in the inspection chamber where a lens is placed in a hydrated state. This extra air bubble may interfere with the light path of sensors that are used to inspect the lens. It is difficult to remove these air bubbles and maintain the air-tightness of the lens while it is in the hydrated state.

In view of the above discussion, there is a need for a device that handles the lens in a hydrated state that would overcome the deficiencies noted above.

SUMMARY OF THE INVENTION

Accordingly, the present invention provides improved methods and apparatus for holding a polymeric optical lens, such as an ophthalmic lens (contact lens or IOL); or other polymeric item; in a hydrated state in a hydrated lens inspection container ("HLIC") that is conducive for measurement of characteristics of the ophthalmic lens (or other polymeric item) being inspected. According to the present invention, a HLIC receives the polymeric optical lens into a HLIC lens retention cavity, and a hydration fluid fills the HLIC to a level above a cavity upper edge of the HLIC container. The hydration fluid is permitted to reach a level above the cavity upper edge via formation of a meniscus with the hydration liquid.

The HLIC is inserted into a hydration container handler. The hydration container handler seals the hydration fluid within the HLIC in a manner that dispels atmospheric gases via a closure process. The closure process may include sliding the HLIC onto a receiving guide while an upper seal flattens the meniscus surface, and the hydration fluid completely fills an area within the lens retention cavity.

Inspection may measure one or more lens characteristics such as: optical power, base curve, and diameter. Additional inspection processes may measure one or more of: lens diameter, optical zone diameter; base curve radius; lens power; thickness check; edge quality, UV protection; axial thickness profile, air lens power (P), lens index of refraction (n), center thickness (CT), back surface radius of curvature (RB), or other lens characteristic.

Certain embodiments disclosed herein include A method of inspecting an ophthalmic lens, the method includes the steps of: containing a hydration fluid within a Hydrated Lens Inspection Container ("HLIC"); positioning the ophthalmic lens within the hydration fluid contained within a hydrated lens inspection cavity in the HLIC; forming a meniscus with the hydration fluid; raising an upper HLIC guide on a HLIC Handler relative to a lower HLIC guide on the HLIC handler; inserting the HLIC into the HLIC handler; and lowering the upper HLIC guide on the HLIC Handler relative to the lower HLIC guide on the HLIC handler to seal the hydration fluid and the ophthalmic lens within the hydrated lens inspection cavity.

Certain embodiments disclosed herein also include Apparatus for handling a lens inspection container, the apparatus includes: a receiver for a Hydrated Lens Inspection Container ("HLIC"); an upper HLIC seal fixedly attached to a top portion of the receiver; an upper HLIC guide extending along a length of the upper HLIC seal; a lower HLIC guide fixedly attached to a bottom portion of the receiver; a lower HLIC guide extending along a length of a lower HLIC seal; a fulcrum rotationally connecting the upper HLIC seal with a handle; and a fulcrum gap formed into the receiver and permitting rotational movement of the upper HLIC seal.

Certain embodiments disclosed herein further include an apparatus for handling a container, the apparatus includes: a receiver; an upper seal extending from the receiver form a fulcrum gap between the receiver and the upper seal; an upper guide extending along a length of the upper seal; and a fulcrum located at where the upper seal extends from the receiver, wherein the receiver is configured to receive the container having a hydration fluid that forms a meniscus forming a seal against the upper seal, upon insertion of the container towards the receiver.

DETAILED DESCRIPTION OF THE INVENTION

According to the present invention, a Hydrated Lens Inspection Container (sometimes referred to herein as a "HLIC") allows for containment of a polymeric optical lens (or other hydrated item) and also contains a hydrating fluid sealed in the container, and provides optical access to a lens contained within the HLIC for testing or other purposes.

The HLIC is capable of receiving the polymeric optical lens (such as a lens formed via additive manufacturing processes taught in U.S. patent application Ser. No. 17/746,654) into a HLIC lens retention cavity, and filling the HLIC with a hydration fluid a level within a HLIC cavity that expels any atmospheric gas. Inspection may occur through a sidewall of the HLIC.

The hydration is permitted to reach a level above the cavity upper edge via formation of a meniscus with the hydration liquid. The HLIC is inserted into a hydration container handler. The hydration container handler seals the hydration fluid within the HLIC in a manner that dispels atmospheric gases via a closure process. The closure process may include sliding the HLIC onto a receiving guide while an upper seal flattens the meniscus surface, and the hydration fluid completely fills an area within the lens retention cavity.

Inspection may measure one or more lens characteristics such as: optical power, base curve, and diameter. Additional inspection processes may measure one or more of: lens diameter, optical zone diameter; base curve radius; lens power; thickness check; edge quality, UV protection; axial thickness profile, air lens power (P), lens index of refraction (n), center thickness (CT), back surface radius of curvature (RB), or other lens characteristic.

Figure 1:
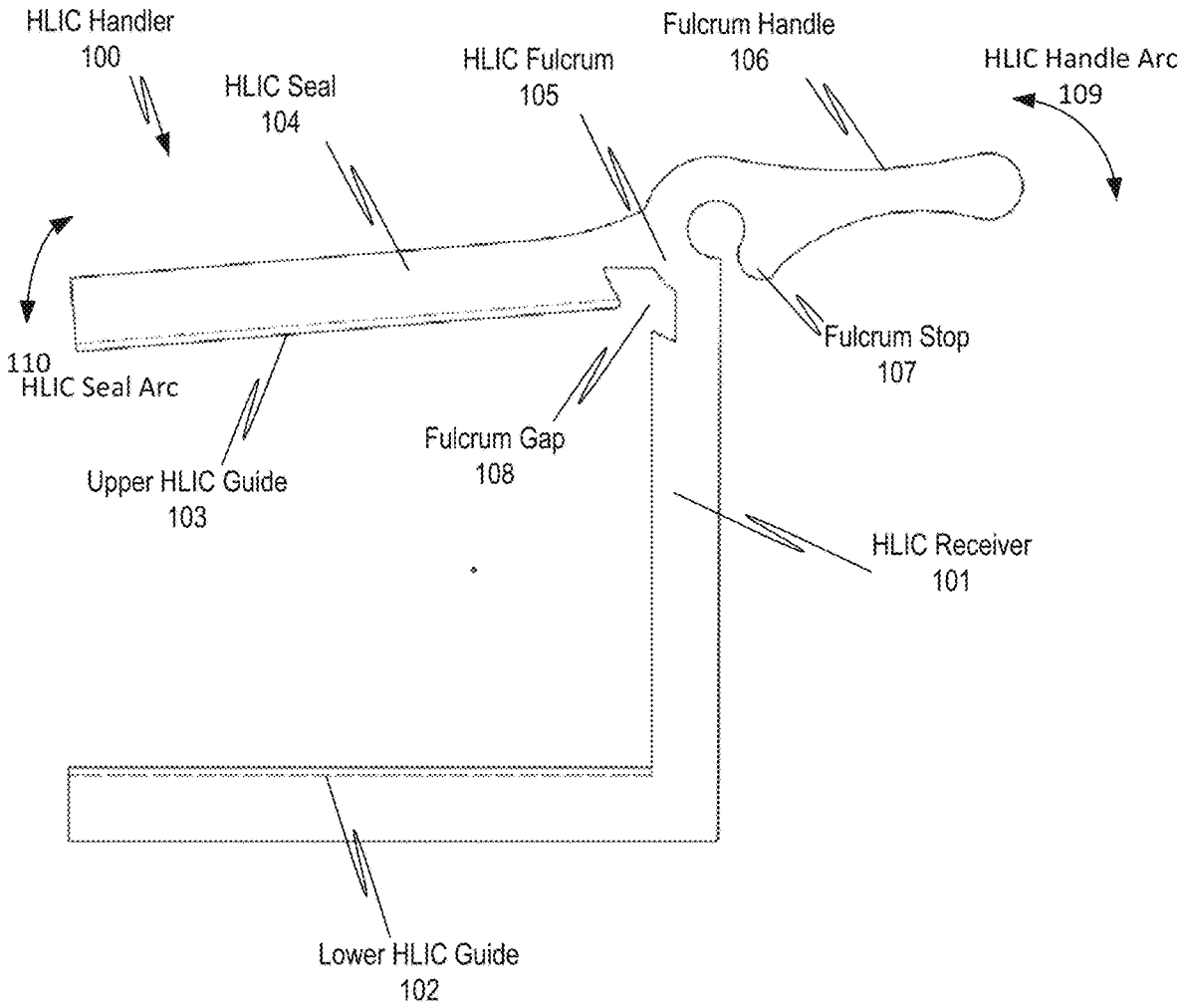
FIG. 1 illustrates a schematic diagram of a HLIC handler, according to some embodiments of the present invention.

Referring now to FIG. 1, a side view of a HLIC Handler 100 is shown with a Fulcrum Handle 106 that may be rotated along a HLIC Handle Arc 109 around a HLIC Fulcrum 105. The HLIC handler may be formed, or include, one or more of: polylactic acid, nylon, Acrylonitrile Butadiene Styrene ("ABS"), or other thermoplastic or other three-dimensional printer or injection moldable material. Movement of the Fulcrum Handle 106 along the HLIC Handle Arc 109 may be controlled with a Fulcrum Stop 107 extending from the Fulcrum Handle 106. An HLIC Receiver 101 may be formed in a size and shape conducive to receiving a HLIC (such as the HLIC illustrated in FIG. 2). Together the Fulcrum Handle 106 and the Fulcrum Stop 107 may rotate together along the HLIC Handle Arc 109 until the Fulcrum Stop 107 contacts the HLIC Receiver 101. An Upper HLIC Guide 103 and a Lower HLIC Guide 102 may provide boundaries as the HLIC is inserted into the HLIC Handler 100. In an embodiment, the Fulcrum 105 is located at where the Upper HLIC Guide 103 extends from the HLIC Receiver 101.

An HLIC Seal 104 may be held in a first position to allow for insertion of the HLIC and movement of the HLIC Handle 106 along a HLIC Handle Arc 109 may be translated at the fulcrum 105 and the fulcrum gap 108 to movement of the HLIC seal 104 along the HLIC Seal Arc 110.

Movement of the HLIC seal 104 along the HLIC Seal Arc 110 brings the HLIC Seal 104 into contact with the HLIC and receives the HLIC to seal hydration fluid and a lens within the HLIC. The HLIC Handler 100 may then be easily manipulated to inspection of the lens suspended in hydration fluid, as the hydration fluid is contained by the HLIC Handler 100 in the HLIC.

Figure 1A:
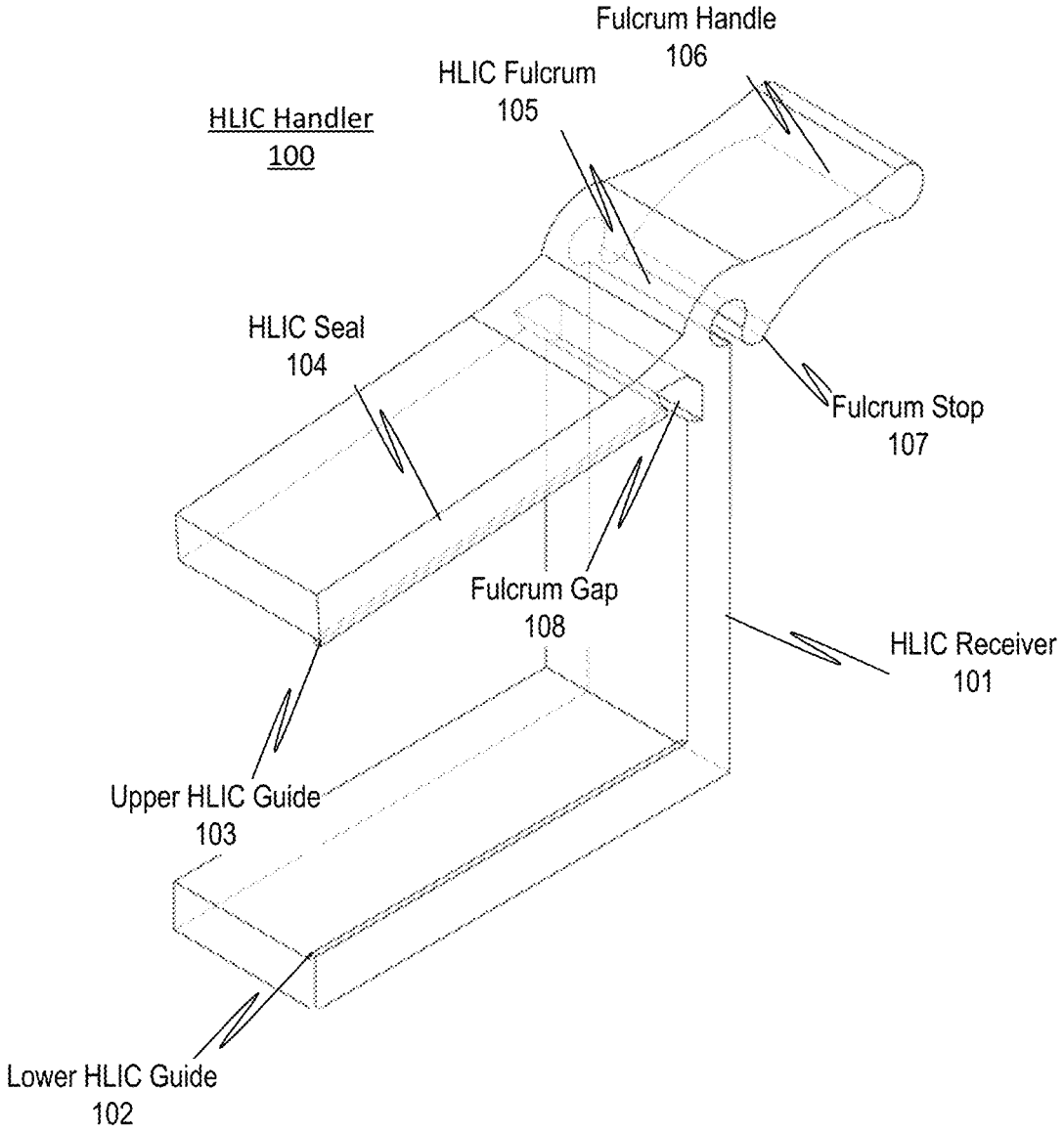
FIG. 1A illustrates a schematic diagram of an exemplary a HLIC handler that may be used in some implementations of the present invention.

Referring now to FIG. 1A, a perspective view of the HLIC Handler 100 illustrates how the HLIC Fulcrum 105 and the fulcrum gap 108 may be carried through an entire width of the HLIC Handler 100 along with the Fulcrum Handle 106 and the HLIC Receiver 101. In alternate embodiments, a fulcrum stop 107 may be across the width of the HLIC Handler 100 (as illustrated) or in portions of the HLIC Handler 100 width.

The Lower HLIC Guide 102 and the Upper HLIC Guide 103 are illustrated along a single edge of the HLIC Seal 104, however, alternate embodiments may include a Lower HLIC Guide 102 and the Upper HLIC Guide 103 along both edges of the HLIC Seal 104.

Figure 2:
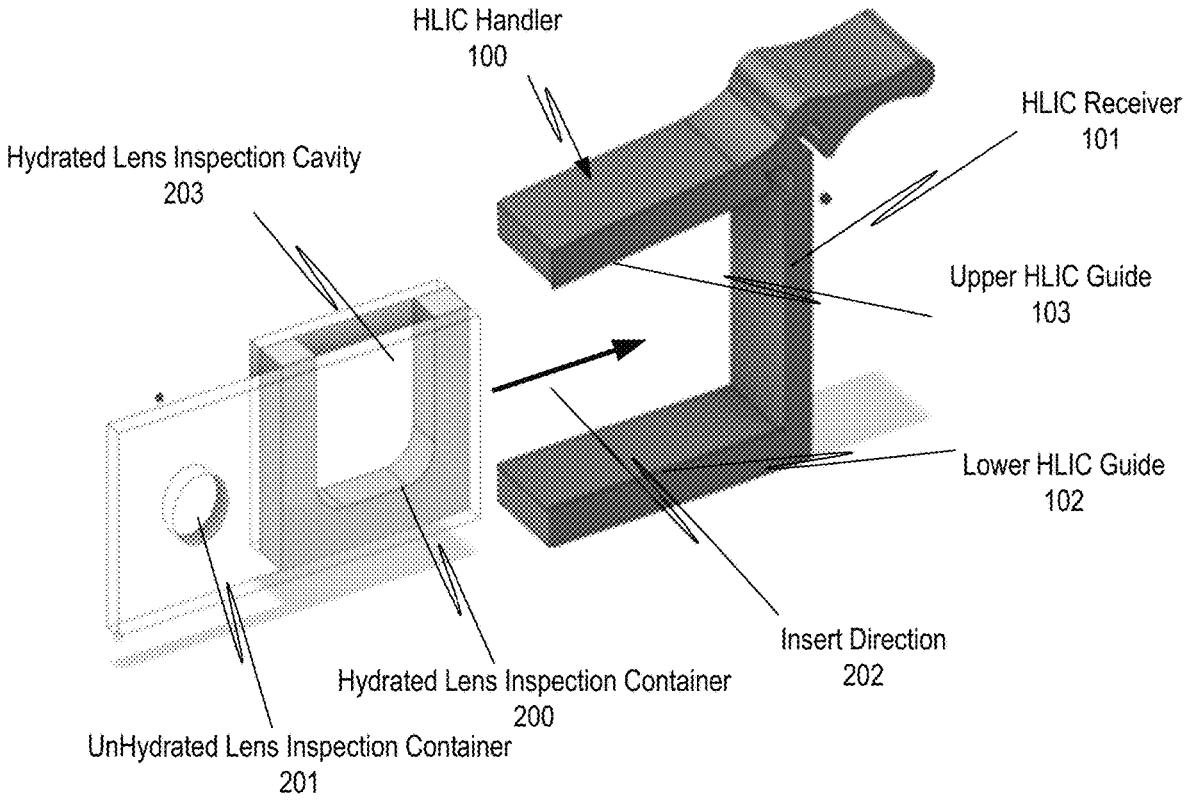
FIG. 2 is a schematic illustration of an exemplary a HLIC handler receiving a hydrated lens inspection container, according to some embodiments of the present invention.

Referring now to FIG. 2, a perspective view of a HLIC Handler 100 according to some embodiments of the present invention is shown in position to receive a HLIC 200 having a Hydrated Lens Inspection Cavity 203. As illustrated the HLIC 200 is coupled to an Unhydrated Lens Inspection Container 201 (which may be referred to as a "ULIC"). The HLIC 200 may be configured to slide in an insert direction 202 along the Lower HLIC Guide 102 and the Upper HLIC Guide 103 until the HLIC 200 contacts with the HLIC Receiver 101. As shown in FIG. 2, the Lower HLIC Guide 102 and the Upper HLIC Guide 103 are located on a same side along a width end of the HLIC Handler 100. However, in alternative embodiments the Lower HLIC Guide 102 and the Upper HLIC Guide 103 are located on opposite ends along a width of the HLIC Handler 100, so long as they are configured to receive and guide the HLIC 200 and allow the HLIC to slide in the insert direction 202 until the HLIC 200 contacts with the HLIC Receiver 101

Figure 2A:
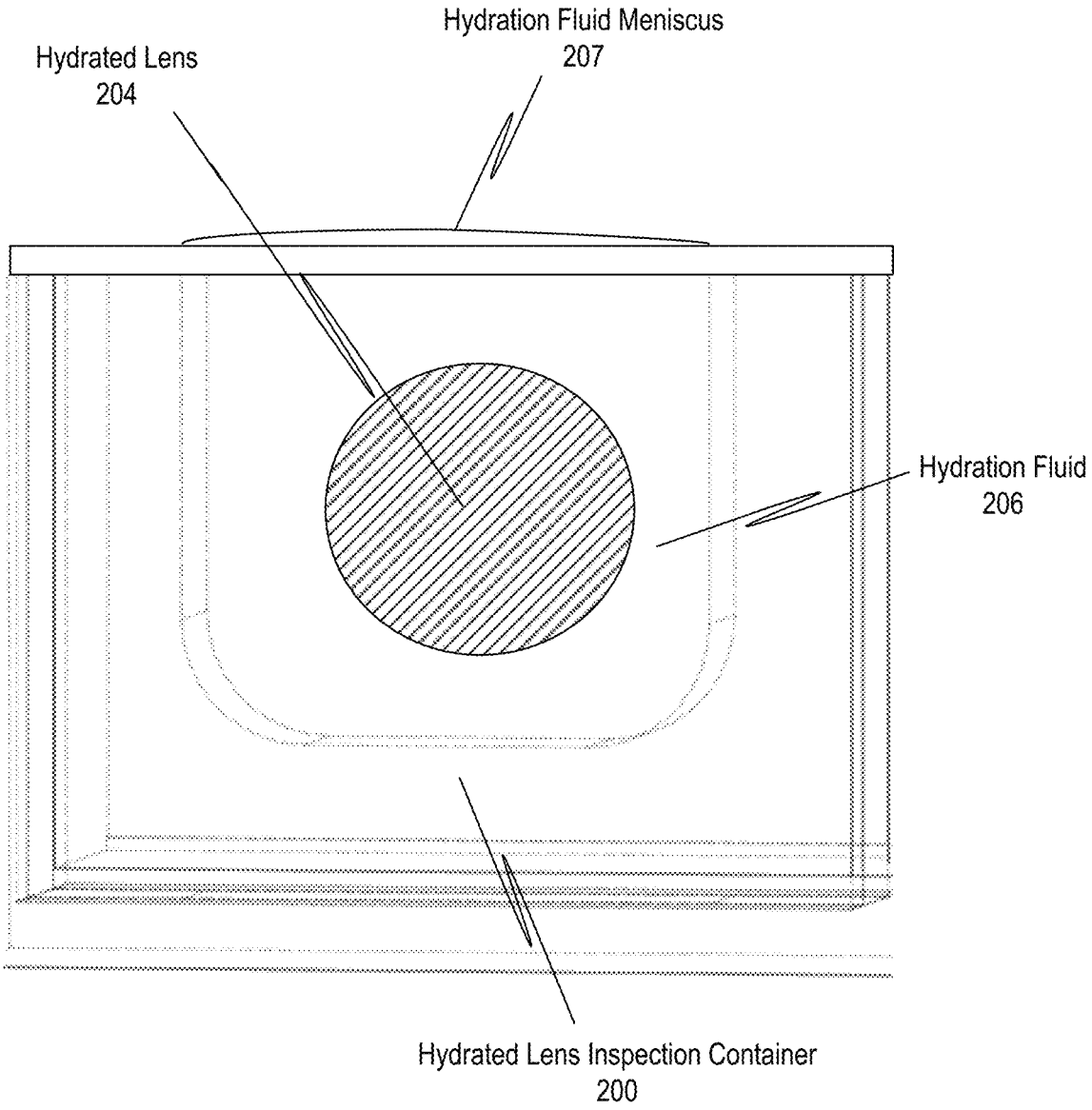
FIG. 2A is a schematic illustration of an exemplary a HLIC containing a lens for inspection and hydration fluid, according to some embodiments of the present invention.

Referring now to FIG. 2A, a HLIC 200 is illustrated containing a hydration fluid 206. The hydration fluid 206 hydrates a hydrated lens 204 and also forms a meniscus 207 (which includes a curved upper surface of a liquid in the HLIC) the meniscus 207 may form as a crescent or other arcuate shape across the HLIC cavity 203 as a result of surface tension that occurs between the hydration fluid coming in contact with a top surface of the HLIC 200 as the hydration fluid fills the HLIC cavity 203 (i.e., as the hydration fluid fills the HLIC 200 to a level above a cavity upper edge of the HLIC 200). The meniscus provides sufficient hydration fluid 206 to seal against the HLIC Seal 104 with very little or no atmospheric gases trapped in the HLIC Handler 100.

Figure 2B:
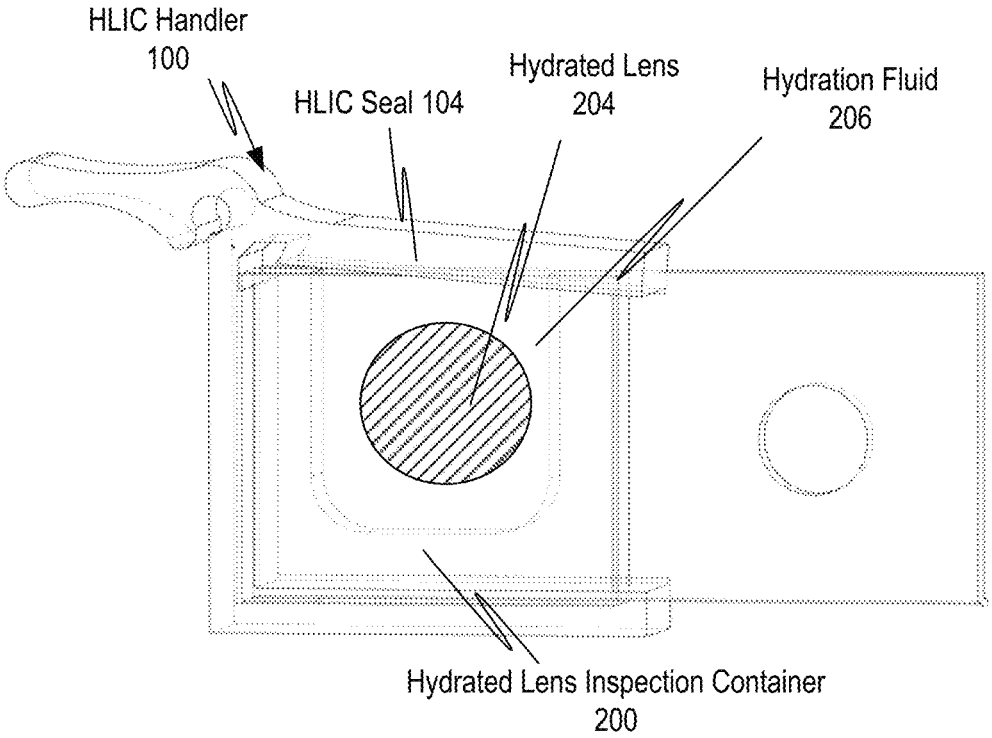
FIG. 2B is a schematic illustration of an exemplary a HLIC handler holding a HLIC containing a lens for inspection and hydration fluid, according to some embodiments of the present invention.

Referring now to FIG. 2B a schematic diagram of a HLIC handler 100 with a HLIC 200 scaled within the HLIC Handler 100 is illustrated. As shown the hydration fluid is contained within the HLIC 200 while the HLIC is sealed within the HLIC Handler 100 which allows for ease of handling and ensures that a hydrated lens 204 is maintained in a hydrated states during handling and inspection. The HLIC Handler 100 also seals out particulate, debris, contaminants, or other items or gases that may interfere with accurate inspection of the hydrated lens.

Figure 3:
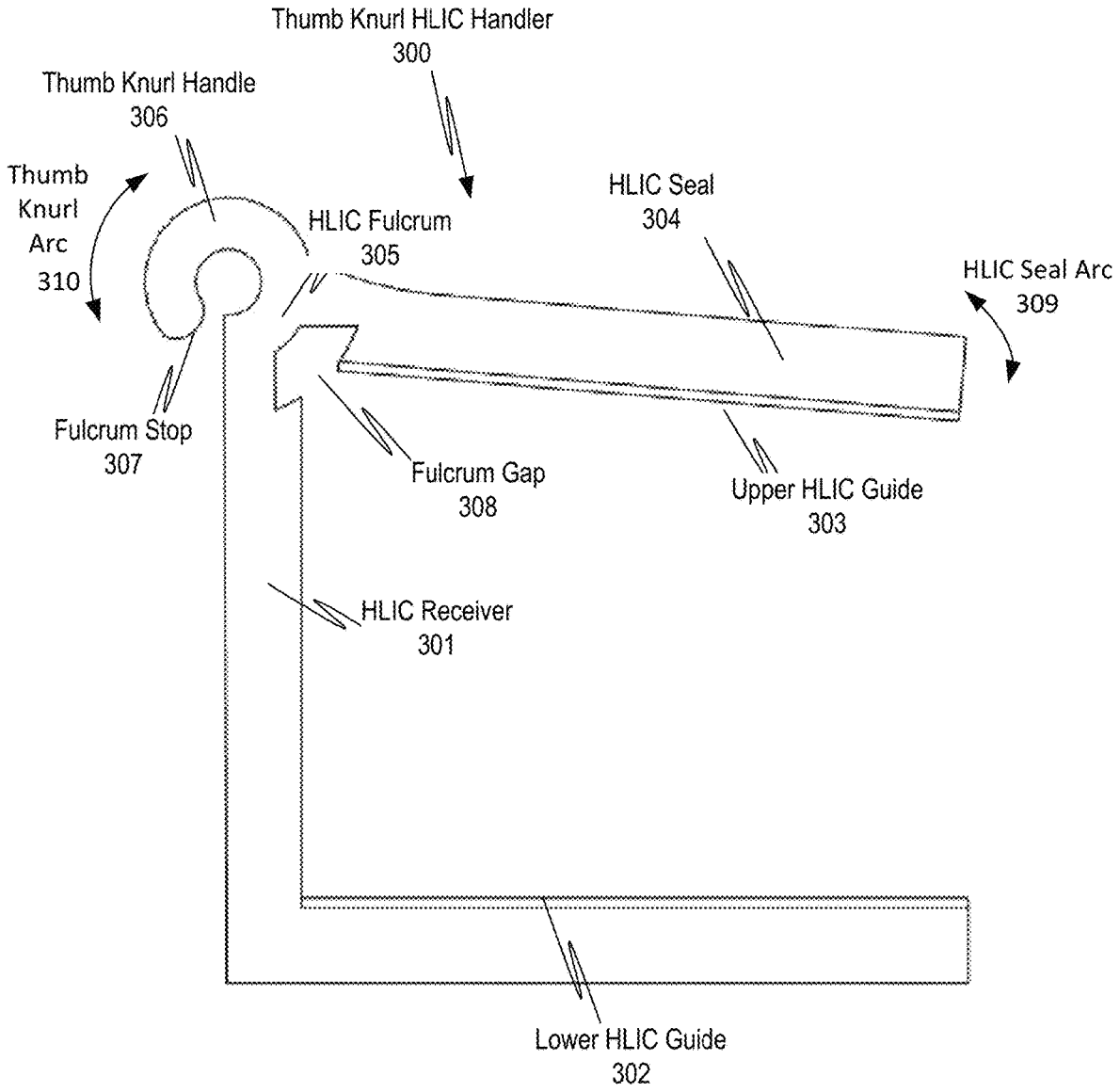
FIG. 3 illustrates a schematic diagram of a HLIC handler with a thumb knurl that may be used in some implementations of the present invention.

Referring now to FIG. 3, in some alternate embodiments of the present invention, a Thumb Knurl Handler 300 may replace a fulcrum handle (not shown in FIG. 3) with a thumb knurl handle 106. The thumb knurl handle 306 may be rotationally moved via rotational pressure along a thumb knurl arc 310. The rotational movement may be around a HLIC fulcrum 305 and contained with a fulcrum stop 307. The movement of the thumb knurl handle 306 along the thumb knurl arc 310 causes the HLIC seal to rotationally move along a HLIC Seal Arc 309 about a HLIC Fulcrum 305 and through a Fulcrum Gap 308 formed by the intersection between an HLIC Receiver 301 and an HLIC Seal 304 at the HLIC Fulcrum 305.

One or more Lower HLIC Guides 302 and one or more Upper HLIC Guides 303 may be used to guide the insertion of an HLIC (not shown) into the Thumb Knurl HLIC Handler 300.

Figure 3A:
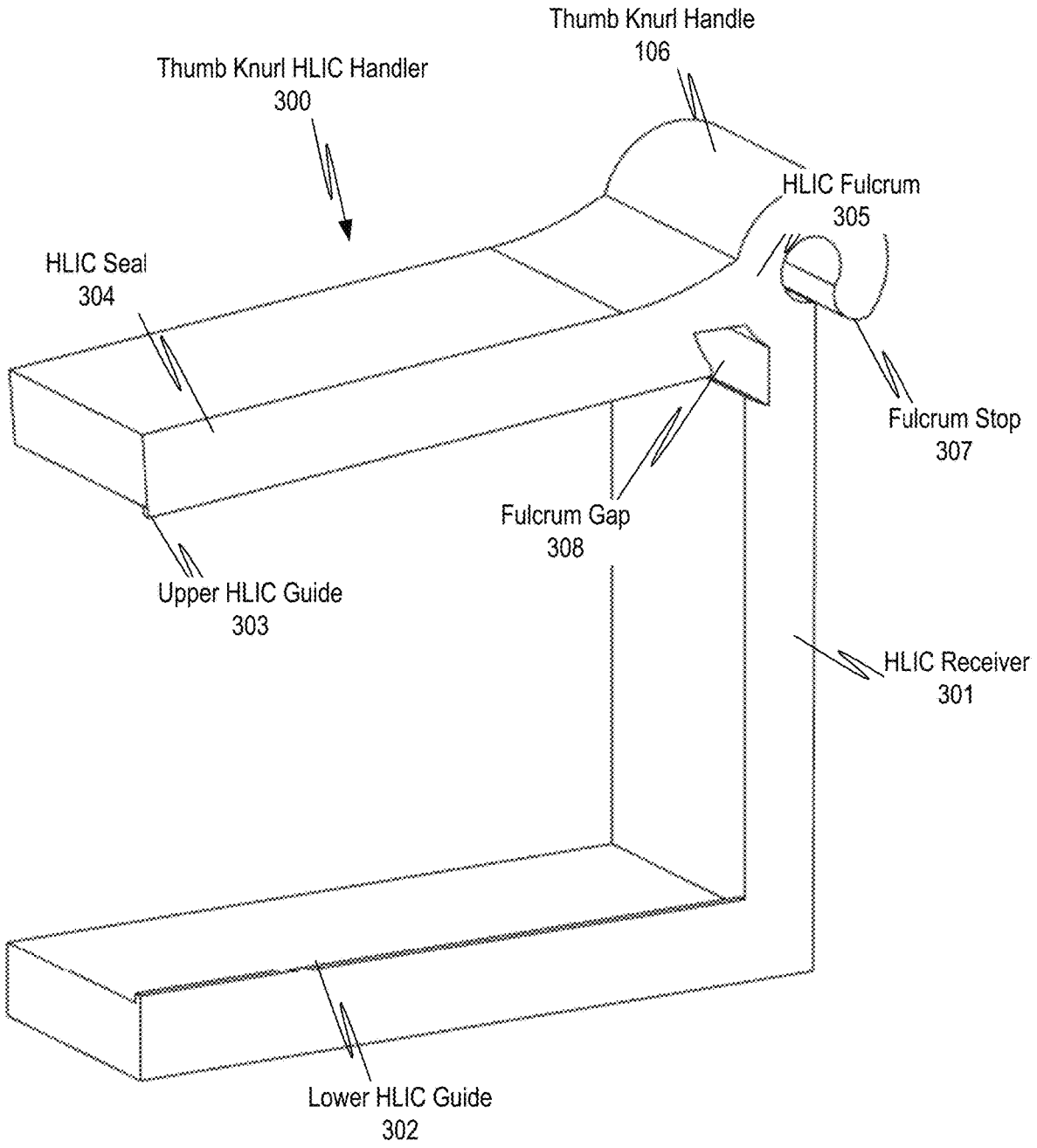
FIG. 3A illustrates a schematic diagram of a perspective view of a HLIC handler with a thumb knurl that may be used in some implementations of the present invention.

Referring now to FIG. 3A, a perspective view of the Thumb Knurl HLIC Handler 300 illustrates how the HLIC Fulcrum 305 and the fulcrum gap 308, which is formed by the intersection between the HLIC Seal 304 and the HLIC receiver 301 at the HLIC Fulcrum 305 where the Thumb Knurl Handle 106 may be carried through an entire width of the Thumb Knurl HLIC Handler 300. In alternate embodiments, a fulcrum stop 307 may be across the width of the Thumb Knurl HLIC Handler 300 (as illustrated) or in portions of the Thumb Knurl HLIC Handler 300's width.

The Lower HLIC Guide 302 and the Upper HLIC Guide 303 are illustrated along a single edge of the HLIC Seal 304, however, alternate embodiments may include a Lower HLIC Guide 102 and the Upper HLIC Guide 303 along both edges of the HLIC Seal 304.

Figure 4:
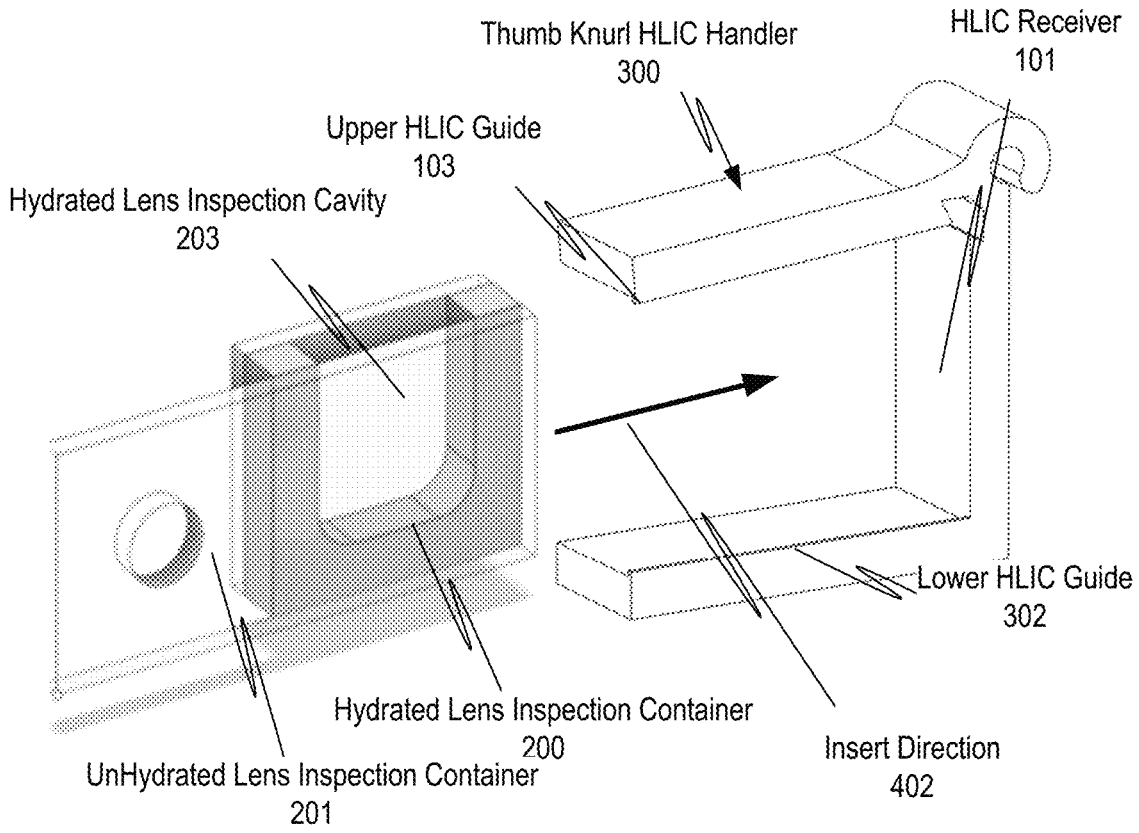
FIG. 4 illustrates a schematic diagram of a perspective view of a HLIC handler with a thumb knurl receiving a HLIC.

Referring now to FIG. 4, a perspective view of a Thumb Knurl HLIC Handler 300 according to some embodiments of the present invention is shown in position to receive a HLIC 200 having a Hydrated Lens Inspection Cavity 203. As illustrated the HLIC 200 is coupled to an Unhydrated Lens inspection Container 201 (which may be referred to as a "ULIC"). The HLIC 200 may slide in an insert direction 402 along the Lower HLIC Guide 302 and the Upper HLIC Guide 103 until the HLIC 200 contacts the HLIC Receiver 101.

Figure 5:
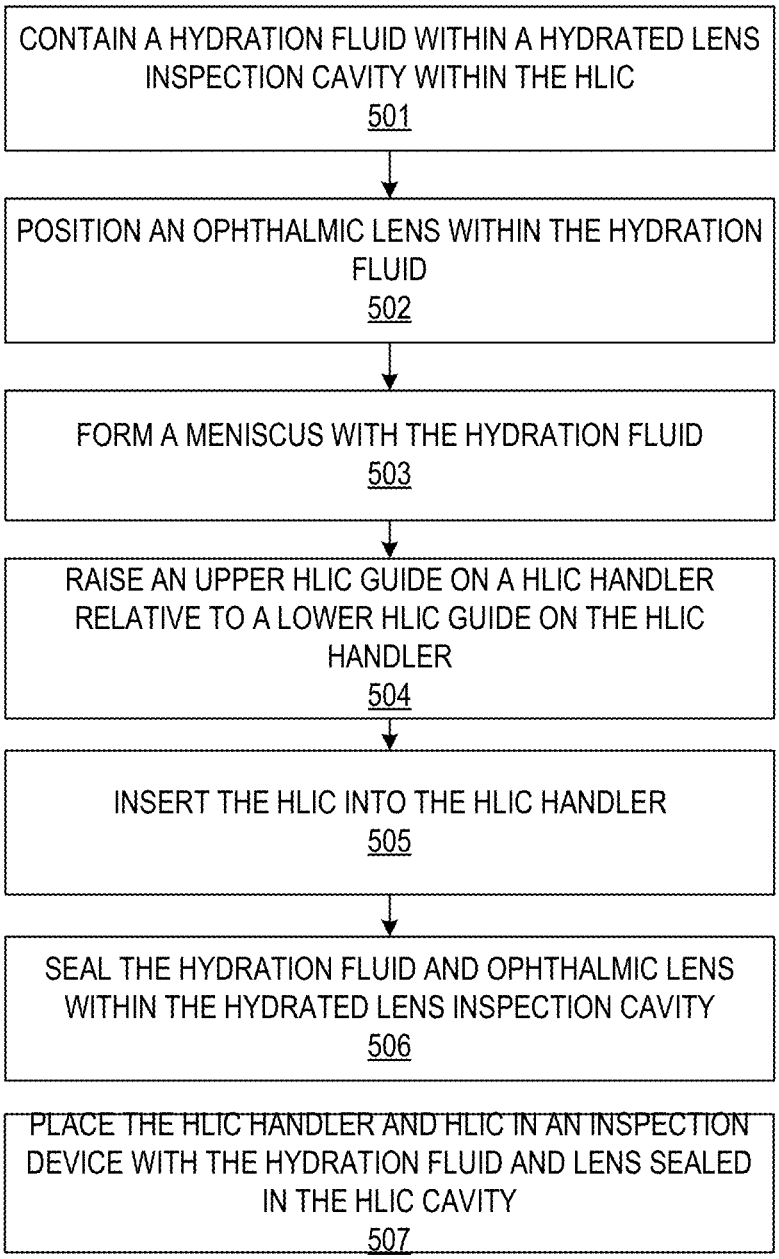
FIG. 5 illustrates a flowchart of method steps that may be executed in some implementations of the present invention.

Referring now to FIG. 5, method steps that may be executed according to some embodiments of the present invention are listed.

In some embodiments, at step 501, methods may include containing a hydration fluid within a Hydrated Lens Inspection Container (HLIC).

At step 502, methods may also include positioning ophthalmic lens within the hydration fluid contained within a hydrated lens inspection cavity in the HLIC.

At step 503, methods may also include forming a meniscus with the hydration fluid.

At step 504, methods may also include raising an upper HLIC guide on a HLIC Handler relative to a lower HLIC guide on the HLIC handler.

At step 505, methods may also include inserting the HLIC into the HLIC handler.

At step 506, methods may also include lowering the upper HLIC guide on a HLIC Handler relative to the lower HLIC guide on the HLIC handler, effectively sealing the hydration fluid and the ophthalmic lens within the hydrated lens inspection cavity; and at step 507, the methods may furthermore include placing the HLIC handler and the HLIC in an inspection device within the hydration fluid and lens sealed in the HLIC cavity.

CONCLUSION

A number of embodiments of the present disclosure have been described. While this specification contains many specific implementation details, there should not be construed as limitations on the scope of any disclosures or of what may be claimed, but rather as descriptions of features specific to particular embodiments of the present disclosure.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A method of inspecting an ophthalmic lens, the method comprising the steps of:

a. containing a hydration fluid within a Hydrated Lens Inspection Container ("HLIC");

b. positioning the ophthalmic lens within the hydration fluid contained within a hydrated lens inspection cavity in the HLIC;

c. forming a meniscus with the hydration fluid;

d. raising an upper HLIC guide on a HLIC Handler relative to a lower HLIC guide on the HLIC handler;

e. inserting the HLIC into the HLIC handler; and f. lowering the upper HLIC guide on the HLIC Handler relative to the lower HLIC guide on the HLIC handler to seal the hydration fluid and the ophthalmic lens within the hydrated lens inspection cavity.

2. Apparatus for handling a lens inspection container, the apparatus comprising:

a. a receiver for a Hydrated Lens Inspection Container ("HLIC");

b. an upper HLIC seal fixedly attached to a top portion of the receiver;

c. an upper HLIC guide extending along a length of the upper HLIC seal;

d. a lower HLIC guide fixedly attached to a bottom portion of the receiver;

e. a lower HLIC guide extending along a length of a lower HLIC seal;

f. a fulcrum rotationally connecting the upper HLIC seal with a handle; and g. a fulcrum gap formed into the receiver and permitting rotational movement of the upper HLIC seal.

3. The apparatus of claim 2 wherein the apparatus comprises polylactic acid.

4. The apparatus of claim 2, wherein the fulcrum gap extends through an entire width of the apparatus.

5. The apparatus of claim 2, wherein the handle is a fulcrum handle.

6. The apparatus of claim 2, wherein the handle is a thumb knurl handle.

7. The apparatus of claim 2, further comprising a fulcrum stop extending from the handle.

8. The apparatus of claim 7, wherein the handle is configured to rotate along a HLIC Handle Arc around an HLIC fulcrum until the fulcrum stop makes contact with the receiver.

9. The apparatus of claim 7, wherein the fulcrum stop extends across an entire width of the apparatus.

10. The apparatus of claim 2, wherein the HLIC seal is fixedly attached to the top portion of the receiver at an HLIC fulcrum.

11. The apparatus of claim 10, wherein the HLIC seal is configured to rotate along a HLIC seal arc around the HLIC fulcrum until HLIC seal contacts the receiver.

12. The apparatus of claim 2, wherein the HLIC seal is configured to receive the HLIC and seal a hydration fluid and a lens within the HLIC.

13. The apparatus of claim 12, wherein the hydration fluid forms a meniscus to seal against the HLIC seal.

14. The apparatus of claim 2, wherein the HLIC has a hydrated lens inspection cavity configured to receive a lens and a hydration fluid.

15. The apparatus of claim 14, wherein the hydration fluid forms a meniscus to seal against the HLIC, upon filling the hydrated lens inspection cavity and contacting a top surface of the HLIC to seal against the HLIC seal.

16. The apparatus of claim 14, wherein the HLIC is coupled to an unhydrated lens inspection container.

17. The apparatus of claim 16, wherein the unhydrated lens inspection container is coupled to the HLIC at a same side of the HLIC that contacts with one of the upper HLIC guide and the lower HLIC guide.

18. The apparatus of claim 2, wherein the upper HLIC guide and the lower HLIC guide are located on a same side of the apparatus.

19. The method of claim 1, wherein the HLIC comprises an upper HLIC seal and a receiver, wherein the hydration fluid and the ophthalmic lens are sealed upon the meniscus coming in contact with one of the upper HLIC seal or the upper HLIC guide as the HLIC is inserted into the HLIC handler and contacts the HLIC receiver.

20. An apparatus for handling a container, the apparatus comprising:

a. a receiver;

b. an upper seal extending from the receiver to form a fulcrum gap between the receiver and the upper seal;

c. an upper guide extending along a length of the upper seal; and d. a fulcrum located at where the upper seal extends from the receiver, wherein the receiver is configured to receive the container having a hydration fluid that forms a meniscus forming a seal against the upper seal, upon insertion of the container towards the receiver.

* * * * *